United States Patent [19]

Mains

[11] 4,261,188

[45] Apr. 14, 1981

[54] MATERIAL IMMERSION APPARATUS

[75] Inventor: Frank Mains, Don Mills, Canada

[73] Assignee: Kroy Unshrinkable Wools Limited, Toronto, Canada

[21] Appl. No.: 942,921

[22] Filed: Sep. 18, 1978

Related U.S. Application Data

[63] Continuation-in-part of Ser. No. 685,251, May 11, 1976, abandoned.

[30] Foreign Application Priority Data

May 15, 1975 [GB] United Kingdom ..... 20652/75

[51] Int. Cl.[3] ..... D06B 3/02

[52] U.S. Cl. ..... 68/62; 68/158; 68/175; 68/207

[58] Field of Search ..... 68/9, 10, 27, 44, 62, 68/158, 175, 178, 179, 181 R, 184, 207; 134/64 R, 64 P, 122 R, 122 P

[56] References Cited

U.S. PATENT DOCUMENTS

| | | | |
|---|---|---|---|
| 1,665,230 | 4/1928 | Spalding | 68/175 X |
| 2,552,078 | 5/1951 | Williams | 68/44 |
| 2,720,443 | 10/1955 | Keggin | 68/181 R X |
| 3,016,729 | 1/1962 | Menzel | 68/184 X |
| 3,315,501 | 4/1967 | Muller | 68/175 X |
| 3,616,663 | 11/1971 | Matsuda | 68/184 |
| 3,830,084 | 8/1974 | Caputi | 68/178 |
| 4,038,842 | 8/1977 | Mizutani | 68/175 X |

FOREIGN PATENT DOCUMENTS

| | | | |
|---|---|---|---|
| 28100 | of 1903 | United Kingdom | 68/184 |
| 49-23262 | 6/1974 | Japan | 68/175 |

*Primary Examiner*—Philip R. Coe

*Attorney, Agent, or Firm*—Schwartz, Jeffery, Schwaab, Mack, Blumenthal & Koch

[57] ABSTRACT

According to the invention disclosed herein wool sliver may be effectively shrinkproofed by immersing the sliver continuously into a bath of shrinkproofing solution to a depth of at least 1 meter if said sliver is carried down into said solution within 10° of vertical. According to the invention the most useful solution is an aqueous solution into which chlorine gas has been aspirated. An apparatus according to the invention comprises a two chambered bath having a delay tank therebetween, having a depth exceeding 1 meter and equipped with means to convey wool sliver into said bath within 10° of vertical.

9 Claims, 1 Drawing Figure

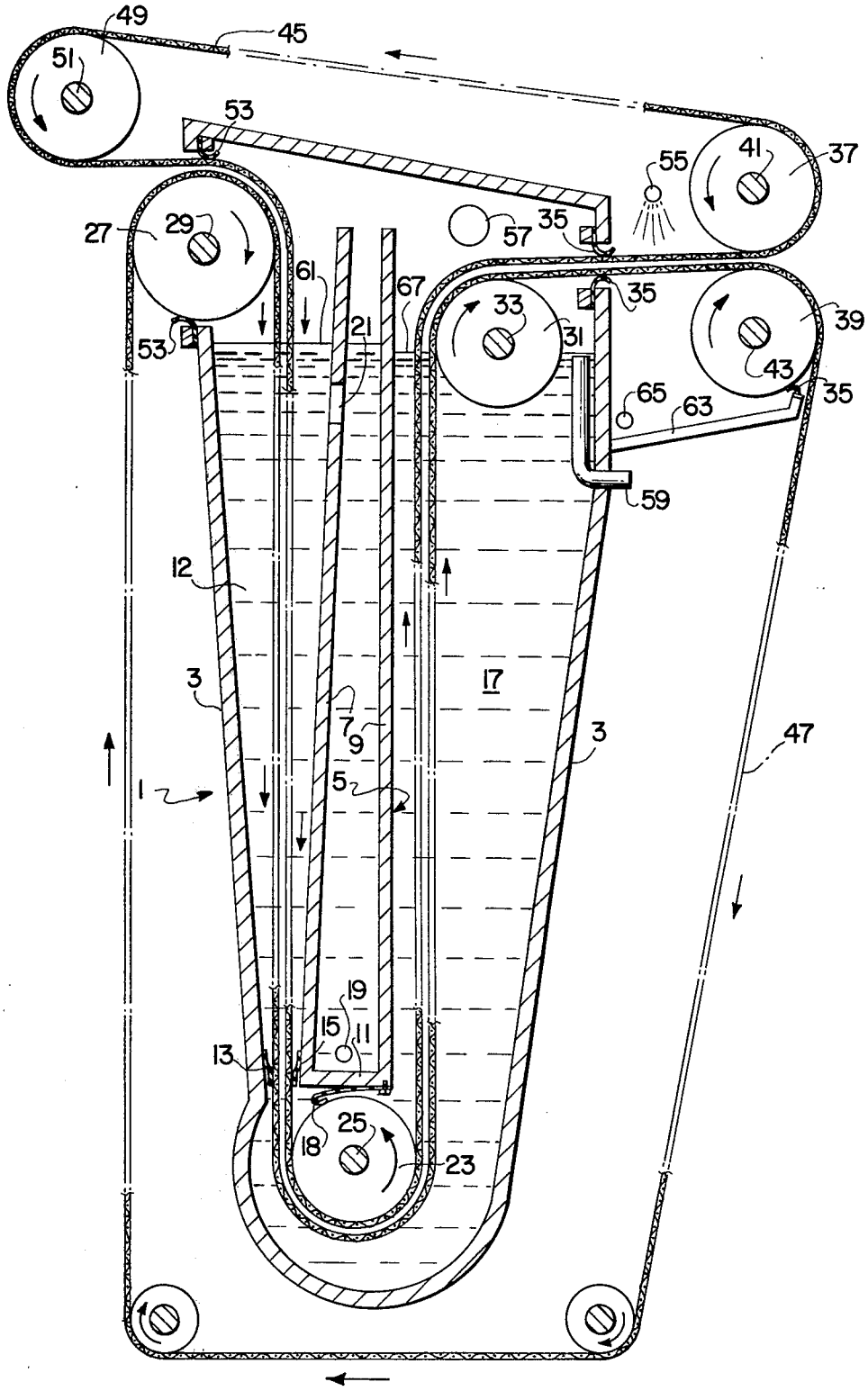
49
45
51
53
55
41
37
27
29
57
35
61
67
33
35
39
53
21
31
43
65
63
35
59
12
17
3
7
9
3
47
1
5
19
15
11
13
25
18
23

MATERIAL IMMERSION APPARATUS

CROSS REFERENCE

This application is a Continuation-in-Part of my prior application Ser. No. 685,251, filed May 11, 1976, and now abandoned.

BACKGROUND OF THE INVENTION

This invention relates to the shrinkproofing of wool sliver. Disclosed herein is a novel process and an apparatus particularly suitable for carrying out the novel process. Also disclosed herein is a particular solution which is advantageous in the shrinkproofing of wool, not only with the novel apparatus and process disclosed herein but generally in the field of shrinkproofing of wool.

Wool sliver is a commercial product which is produced in a variety of relatively uniform sizes. Sliver is normally described in terms of its quality and in terms of the weight of a 5 yard length of material. Thus, a 2½ ounce sliver indicates that this particular sliver would weigh 2½ ounces for a 5 yard length. This sliver would be approximately 1 inch in diameter.

In the normal processing of wool, wool fibers are obtained by clipping from an animal. The clipped fibers are then baled. After collection in bales the raw wool may be scoured and carded. In this state the wool is referred to as card sliver. Card sliver upon combing to remove adventitious materials receives a slight twist and is referred to as top sliver. Top sliver may be drawn such that its diameter is reduced at which time it is then referred to as roving. Roving may be twisted into yarn. Several plies of yarn may be then twisted to form a thread. Generally speaking, wool will be treated while in either the card sliver or top sliver state. However, the invention disclosed hereinafter is useful in any of the stages from card sliver through to thread. Accordingly, the word "sliver" as used hereinafter is intended to be broad enough to encompass card sliver, top sliver, roving, yarn and thread.

It is well known in the prior art that wool sliver may be shrinkproofed by immersing it in an aqueous hypochlorite solution. There has been much technical study and many patents in this field.

It is generally acknowledged that the major reactant involved is hypochlorous acid which is one of the entities in wet chlorine systems, and that the reaction should, as far as possible, be confined only to the surface of the fibers. The reaction between wool and hypochlorous acid tends to be exceedingly rapid and difficult to control so that the major difficulty is one of obtaining "even treatment" of the fibers.

Since the chemical equilibrium involved in HOCl solutions is very pH dependent and since the by-product of the HOCl/wool reaction is the completely dissociated HCl, a self accelerating action is set up at the original reaction site.

Since the rate of the wool/hypochlorous reaction is so fast, it is possible for some of the fibers to be "wetted" by reactant solution which has lost its HOCl content in a first reaction. It is obvious, then, that if the reactant solution is to maintain homogeneity, the rate of its dispersion through the fibers must be faster than the wool/hypochlorous reaction rate if the desired end of even treatment is to be met. To achieve this, several methods have been used to reduce the reaction rate including temperature control; pH modification and addition of sacrificial amino compounds. Any or all of these methods have been coupled with agitation, vibration or wetting agent additions to speed the rate of liquid dispersion. Despite all of this work, the attainment of even treatment is still a major difficulty.

It is in the nature of this invention, that even and homogenous treatment of combed wool sliver can be obtained by use of a mechanical procedure designed to take specific advantage of the geometry of combed wool sliver.

The invention is based in the discovery that the rate of air displacement by the solution for sliver continuously immersed within 10° of the vertical is smooth and even, whereas for sliver immersed horizontally the rate is slow and discontinuous. Because the sliver consists of combed wool fibers, air trapped in the capillaries will be smoothly and uniformly displaced only if the sliver is introduced in the bath in a substantially vertical direction. Immersion of the sliver in the bath in a horizontal direction or nearly horizontal direction will result in entrapment of the air in the capillaries of the sliver and thereby resulting in uneven shrinkproofing of the wool.

Heretofore, wool sliver has been immersed in an appropriate bath at any convenient angle which normally will approach the horizontal. The sliver then travels in a more or less horizontal plane through the bath for an appropriate amount of time to permit treatment by the solution. In order to assist in the treating of the sliver with this type of bath and immersion arrangement the bath is often agitated.

According to this invention the wool sliver is introduced into the bath in a substantially vertical direction and travels downward through the solution in a substantially vertical direction to an appropriate depth. By a suitable choice of the depth to which the sliver is immersed and the rate at which it is carried into the bath, it is possible to obtain even and homogenous filling of the capillary spaces between the combed fibers with reactant liquid in a time less than that required for the wool/hypochlorite reaction. The combed wool sliver (whose capillaries are filled with air) is conveyed substantially vertically into the reactive chlorine solution to a depth of not less than 1 meter at a rate of about 7 centimeters to about 25 centimeters per second. The sliver must be submerged substantially vertically to a depth of at least 1 meter in order that all air may be removed from the capillaries in order that even treatment of the sliver will be achieved. Because the sliver is a relatively delicate product which cannot be subjected to tensile stresses of any significance the sliver may most advantageously be carried into the bath between or on endless screens.

While the sliver is being submerged the air is smoothly displaced from the capillaries by the chlorine liquor. The screens carry the combined wool sliver and capillary liquor around a roll or guide at the bottom of the tank and up through the solution and out of the bath exit.

The sliver now evenly wetted with reactant liquor, is allowed to complete its reaction and is then squeezed, rinsed free from spent liquor and dried.

Sliver so treated is very evenly shrinkproofed and the secondary procedures of attempting to control the rate of reaction by adjustment of pH, of temperature or by adding amino compounds; or of improving the wetting rate by the use of surfactants or agitators or vibrators seem to be unnecessary. The degree of shrinkproofing is easily controlled by adjusting the concentration of hypochlorous acid in the solution.

In essence, an apparatus designed according to this invention consists of a bath of sufficient depth to permit immersion of sliver to a depth of at least 1 meter of fluid. The apparatus will consist of a pulley or guide at the top over which the sliver and its conveying means may be made to pass. A similar pulley or guide will be located at the bottom of the tank. And thirdly, a similar pulley or guide will be located at the exit to withdraw the sliver and conveying means from the tank.

Normally, the final guiding member will be located atop the bath in such a way as to withdraw the wool sliver from the bath as quickly as possible. As the feed rate of sliver is governed by the immersion rate into the bath, obviously withdrawal from the bath in minimum time may only be achieved by removing the sliver according to the shortest path, i.e. vertical. This is desirable although not necessary in order to prevent secondary oxidation by diffusion of more hypochlorous acid. If the sliver is overtreated wool of an unsatisfactory quality and color will result. However, if suitable sealing means could be provided it would be permissible within the terms of this invention to remove the wool sliver from the solution in any particular direction.

Over-treatment of the wool may be easily prevented by use of a U-shaped bath. If a suitable hypochlorous solution is introduced into such a bath at a point relatively near to the point where the wool sliver is introduced, the liquor is fresh. By ensuring a flow of liquor along the U-shaped bath in the same direction of flow as followed by the wool the liquor relatively near the point where the wool is withdrawn from the bath will be weak or spent. Thus, the liquor is caused to flow down one side of the U-shaped bath in which the sliver is traveling downwardly and up in the other leg of the bath. Supply means are incorporated in upper portions of the first mentioned leg of the bath and drain means are provided at the upper end of the second mentioned leg. As the wool sliver is removed from the bath it will of course remove with it some entrapped liquid.

The solution to be used in such a bath is a hypochlorite solution. The best solution known to the inventor is made by passing chlorine gas into water. Such a solution contains less chloride ion than solutions commercially used today, and accordingly has a higher concentration of hypochlorous acid per unit of available chlorine.

Aqueous solutions of hypochlorite are characterized by the uneasy equilibrium between the components. The equilibrium is very pH dependent and can be characterized thus:

$$\underset{14 \leftarrow pH \rightarrow 1}{OCl + H^+ \rightleftarrows HOCl + H^+ + Cl^- \rightleftarrows H_2O + Cl_2}$$

Consequently, the effective concentration of the HOCl entity is dependent on both the total available chlorine of the solution and its pH value.

Shrinkproofing procedures usually operate with solution of about 0.05% hypochlorous acid obtained by different combination of pH and total chlorine (Harris, U.S. Pat. No. 2,466,695; Edwards, British Pat. No. 537,671; Kroy, U.S. Pat. No. 2,671,006). In summary, the overall reaction could be designated as:

$$\text{Wool} + HOCl \rightarrow \text{oxidized wool} + H^+ + Cl^-$$

The by-product of this reaction (the hydrogen and chloride ions) when released have a very important effect upon the hypochlorite/hypochlorous equilibrium.

In the upper pH conditions (pH 5 to pH 14) the released hydrogen ion converts the unreacted hypochlorite ion to the relatively undissociated hypochlorous acid:

$$O\bar{C}l + H^+ \rightarrow HOCl$$

This secondary hypochlorous acid can produce localized secondary oxidation which may continue so long as hypochlorite ion is available.

Consequently, alkaline hypochlorination (so-called) tends to produce more secondary oxidation (damage) per degree of primary oxidation (shrinkproofing) and this shows as increased damage to the wool fibers.

To offset this, according to prior art procedures, recourse is had to a very rapid treatment with the hypochlorite solution followed by immersion in a stop bath to destroy the residual hypochlorite. The relatively slow rates of liquid diffusion through wool fibers and the exceedingly fast rate of the wool hypochlorite reactions and hypochlorite/hypochlorous equilibria make the procedure exceedingly difficult.

In acid conditions (pH 5 or less) the release of by-product HCl decreases the HOCl concentration:

$$HOCl + H^+ + Cl^- \rightleftarrows H_2O + Cl_2$$

and it is interesting to note that since the by-product releases of $H^+$ and $Cl^-$ are stoichimetric the rate of the reaction is proportional to the square of the hydrogen ion release concentration.

$$K_1 [HOCl] [H^+] [Cl^-] = K_2 [Cl_2]$$

$$\therefore [HOCl] = \frac{K_2}{K_1} \frac{[Cl_2]}{[H^+][Cl^-]}$$

$$\text{since } [H^+] = [Cl^-] \text{ and } \frac{K_2}{K_1} = K$$

$$[HOCl] = K \frac{[Cl_2]}{[H^+]^2}$$

Hence release of by-product $H^+$ and $Cl^-$ from the initial shrinkproofing reaction produces a very dramatic fall in pH equilibrium HOCl content of the shrinkproofing solution.

Consequently, in acid solutions the oxidation by hypochlorous acid is self-limiting at the primary stage and the result is shown in the much lesser degree of damage per effective degree of shrinkproofing.

Commercial hypochlorite solutions have available chlorine values of 1% to 16%. They are invariable alkaline (generally pH 12). They are formed by passing gaseous or liquid chlorine into cooled alkaline solutions. The reaction can be represented thus:

$$Cl_2 + 2NaOH \rightarrow NaCl = NaOCl + H_2O + \text{heat}$$

The reaction is generally stopped a little short of the stoichimetric point so as to keep the solution at pH 12.

To make hypochlorous acid solution such commercial hypochlorite solutions are progressively diluted and neutralized with mineral acid, generally muriatic acid.

There are several objections to this procedure:

1. Alkaline hypochlorite solutions undergo steady degradation with time and with temperature thus:

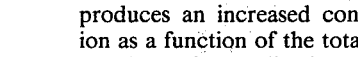

$$NaClO \rightarrow Na^+ + Cl^- + (O)\uparrow$$

Consequently as they age the concentration of chloride ion as a function of available chlorine steadily increases.

2. Acidification means not only the conversion of NaClO to HClO but also the neutralization of the excess alkali in the solution. Consequently this, too, produces an increased concentration of chloride ion as a function of the total available chlorine.
3. The heat of neutralization effectively increases the temperature of the hypochlorous acid solutions and since hypochlorous acid is quite volatile, cooling is required to produce satisfactory shrinkproofing solutions. In such acidified solutions the equilibrium is expressed as:

$$HOCl = \frac{K_1 \times [Cl_2]}{[H^+] \times [Cl^-]}$$

It is obvious that increases in the chloride ion concentration of the solution produce a corresponding reduction in the true [HOCl] per unit of total available chlorine.

Contrary to commercial practice today, the pH and available chlorine values are not sufficient to determine the true concentration of HOCl. To determine true [HOCl] consideration must be given to the chloride ion concentration.

Consequently, acidified solutions of commercial alkaline hypochlorite solutions are lower than expected in true concentration of hypochlorous acid.

However, fresh hypochlorous acid solution can be readily obtained by passing chlorine gas into water:

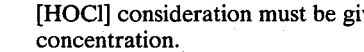

$$Cl_2 + H_2O \rightarrow H^+ + Cl^- + HClO$$

Such a solution proves to be more advantageous for shrinkproofing because it contains less chloride ion (than the previously described acidified commercial product) and therefore has a higher concentration of hypochlorous acid per unit of available chlorine.

It will be appreciated from the previous description that a solution prepared according to the foregoing method will be essentially self limiting in the wool shrinkproofing reaction. Accordingly, it may be used in any form of bath wherein the solution is evenly distributed throughout the wool sliver. Since the reaction is self limiting, it is not necessary to subject the wool sliver to after bath treatment to stop the chemical reaction in order to obtain acceptable quality shrinkproof wool.

In accordance with this invention, effective shrinkproofing solutions may be obtained by aspirating chlorine into the feed water system of the shrinkproofing process. Solutions of available chlorine (0.05 to 0.25) at pH values at 2.0 to 2.6 and temperatures of 6° C. to 20° C. are easily obtained. As a consequence, neither artificial cooling nor cumbersome neutralization procedures are required according to the invention disclosed herein. It will be particularly obvious that the solution disclosed herein may be used advantageously in conjunction with the method and apparatus disclosed herein to provide a single bath treatment of wool wherein the wool is uniformly treated with little or no danger of secondary treatment and damage to the wool.

BRIEF DESCRIPTION OF THE DRAWINGS

The FIGURE of the drawing is a schematic vertical cross-section taken through an apparatus embodying the invention.

DETAILED DESCRIPTION OF THE INVENTION

The apparatus designated generally as 1 comprises a container having an outer shell 3 of a hypochloride resistant material, for example polypropylene or polyvinyl chloride, and defines a liquid holding tank. Inserted within the outer shell 2 of the holding tank is a delay tank 5 which acts as a partition to convert the holding tank 2 into a two legged, V-shaped container. Specifically, the delay tank 5 is comprised of a pair of substantially vertical walls 7 and 9 joined by a bottom portion 11. The inside surface of wall 3 and the outside surface of wall 7 are contoured so as to provide a vertical chamber 12 of steadily diminishing cross-section culminating in a non-return valve formed by wipers 13 and 15.

A second chamber 17 formed by walls 3 and 9, going from bottom to top, has a cross-sectional area which steadily increases. As will be seen below, the fluid passing from chamber 12 to 17 has a maximum velocity at the valve formed by wipers 13 and 15, and one formed by a wiper 18, thus obviating the possibility of spent liquor reversing flow as it enters through an inlet 19 in delay tank 5 and flows into chamber 12 through an opening 21.

Positioned under the delay tank 5 is a bottom roller 23 cooperating with the wiper 18 and positioned on an axle 25. An inlet roller 27 is secured to an axle 29, while an outlet roller 31 is secured to an axle 33 such that tangential lines from roller 27 to roller 23 and from roller 23 to roller 31 are substantially vertical. In this manner sliver can be continuously drawn over roller 27, vertically down to roller 23 and then vertically up to roller 31, passing over it and exiting through a pair of gas seal wipers 35 and then between a pair of squeeze rollers 37 and 39 on axles 41 and 43.

While the reaction between the chlorine gas and water is relatively fast, it is not immediate and hence the mixture of chlorine gas and water is injected into delay tank 5 through inlet 19. The reacted mixture then flows up and out of the slot 21 as discussed above. The delay tank 5, having wall 7 slightly angled, provides a delay period of not less than sixty seconds between entry and overflow.

There are two separate endless belts 45 and 47. Belt 45 passes around a roller 49 on an axle 51 through one of a pair of inlet seals 53. The wool sliver enters between belts 45 and 47 over roller 27. As wool sliver is a relatively delicate product which cannot be subjected to tensile stresses, it is conveyed over the roller 27, between belts 47 and 49 down around roller 23 and up over roller 31. Since the belts 45 and 47 which sandwich the wool sliver are of an open mesh type screen, the liquid has easy access to the wool sliver. The screens are composed of material which is resistant to the action of hypochlorous acid solution. As the sliver passes out through seals 35, it passes under a spray rinse nozzle 55 prior to being squeezed between rollers 37 and 39.

Chlorine gas solutions are not only corrosive, but evolve chlorine gas and hypochlorous acid vapors which are highly toxic. All wool and screen inlets to the device are fitted, as discussed above, with inlet and outlet seals 53 and 35, respectively. There is further an exhaust means connected at 57 to ensure that the reaction vessel is kept under negative pressure with a continuous in-flow of air through seals 53 and 35. The spray rinse 55 ensures that all chlorine liquids are removed from the wool and screens prior to exit from the machine.

It would be appreciated from the above discussion that wool is fed into the inlet over roller 27 and down into chamber 12 where it is saturated by the delayed chlorine liquor flowing continuously from outlet 21 in the delay tank 5. The wool and screens pass up through a lower velocity leg in the form of chamber 17 to the roller 31 where the reacted liquor drains from the wool, exiting through a conduit 59, the outlet level of which is below the inlet level seen at 61. Inflow of fresh liquor at 21 is maintained at such a rate as to produce a one way flow throughout.

The length of the bath in the direction perpendicular to the cross-section illustrated in the FIGURE may be any convenient dimension depending on the number of sliver which are intended to be treated at the same time. As stated above, wool sliver may be in the order of 1 to 1½ inches in diameter. Accordingly, if the bath is required to treat several wool sliver at once in order to match other production, the width of the bath is designed to accommodate the required number of sliver. As most plants will require treatment of more than a single wool sliver at a time, it is suggested that rolls rather than simple pulleys be used to guide the screens. The width of the screens can similarly be chosen to accommodate the number of strands of sliver as desired.

The rate of immersion of the sliver into the bath is controlled by the rate of travel of the screens. An electric motor or other convenient means can be used to drive rolls 27 and 49 or other convenient rolls. It will be appreciated, of course, that in order to prevent damage to the sliver, screens 45 and 47 must travel at the same rate.

As the sliver passes upwardly out of the tank it will pass between the rolls 37 and 39. Rolls 37 and 39 may be conveniently located with their surfaces sufficiently close together to squeeze any excess liquid from the wool sliver. If such a procedure is adopted the excess sliver draining from the capillaries and squeezed from the sliver will together with rinse water from 55 be collected in a trough 63 and exit through an outlet port 65. Thus, the liquid at the exit surface 67 in the upward leg of the bath will be largely spent liquid which is continuously exhausted through outlet 59 to waste. The liquid entering the tank through inlet conduit 19 will be the solution in the desired characteristics of strength, pH and temperature as required.

By use of valves in inlet conduit 19 and outlet conduit 59 the fluid level 61 in the left hand leg 12 is maintained at least 1 meter above the axis of rotation of submerged roll 23. Thus, as the wool sliver travels substantially vertically downward in this leg it will be submerged to a depth of at least 1 meter while traveling in the substantially vertical direction. In this manner, it is ensured that all capillaries of the sliver are completely evacuated of air and filled with reactive liquor.

The apparatus has been illustrated such that each of the conveying screens is guided by a series of six rolls. It will be obvious to those skilled in the art that any number of rolls may be used without departing from the scope of this invention. It will also be obvious that any means of drive could be used to ensure that the two screens travel at the same rate. The only essential is that the lower submerged roll 23 and guide roll 27 must ensure that the sliver enter the bath and travel downwardly therein to a depth of at least 1 meter in a direction which is within 10° or less of the vertical.

While the apparatus disclosed hereinbefore is useful with any of the known shrinkproofing solutions it will be obvious that such apparatus is particularly advantageous when used with the novel solution disclosed herein. As the novel solution disclosed herein is essentially self-limiting in its reaction there will be no need to convey the sliver to a second bath to stop the reaction as the fluid is squeezed from the sliver by roll 37 and roll 39. The sliver may be simply dried and stored for further processing.

Examples illustrating the above-noted invention are set out hereinafter:

EXAMPLE 1

50 Kilograms of a combed wool sliver—64's quality—with a sliver weight of 2 ounces per 5 yards was fed through the machine in the form of 24 parallel slivers at a rate of 18 centimeters per second. The bath contained hypochlorous acid solutions (available chlorine 0.10%) at 8° C. and the tank was kept filled as liquor was continuously removed from it. The exit sliver was squeezed, rinsed and dried. It showed excellent shrinkproofing to standard wash tests and even treatment throughout the sliver in standard dye test.

EXAMPLE 2

50 Kilograms of a combed wool sliver—60's quality, sliver weight—4½ ounces per 5 yards was fed to the machine as 20 parallel slivers at 18 centimeters per second. The bath contained hypochlorous acid solution (0.12% available chlorine) at 10° C. and was kept filled to offset the liquor continuously removed from it. The final sliver showed excellent and homogenous shrinkproofing throughout.

While the invention has been described, it will be understood that it is capable of further modifications and this application is intended to cover any modifications, uses or adaptations of the invention following in general the principles of the invention and including such departures from the present disclosure as come within known or customary practice in the art to which the invention pertains, and as may be applied to the essential features hereinbefore set forth and as fall within the scope of the invention or limits of the appended claims.

What is claimed is:

1. An apparatus for treating material comprising:

(a) a solution container having a first and a second chamber, (b) means for supplying fluid to said first chamber, (c) means for conveying material into said first chamber in a substantially vertical direction, (d) means for conveying material out of said container through said second chamber, (e) a plurality of wipers cooperating with said conveying means for drawing solution from said first chamber into said second chamber and substantially preventing the solution from returning from said second chamber directly back into said first chamber, (f) said container being enclosed, and means for sealing said container relative to the atmosphere being provided adjacent said means for conveying material into and out of the container and means for exhausting vapor from said container.

2. The apparatus of claim 1, wherein said means for conveying the material into said container conveys the material into the solution to a depth of the solution of at least 1 meter in a direction which is not greater than 10° from the vertical, and the material is maintained parallel to the direction of travel.

3. The apparatus of claim 2, comprising means for maintaining a constant fluid level in said container, a first roller mounted within said container for rotation about a horizontal axis, said axis of said first roller being at least 1 meter below the said level of fluid in said container, and a series of rollers, each such roller being mounted for rotation about separate horizontal axes to facilitate travel of said endless members down, around and up from said first roller.

4. The apparatus of claim 1, wherein the means for conveying the material into and out of said container comprises at least two cooperating endless members which members support the material therebetween.

5. The apparatus of claim 1, including a delay tank positioned between said chambers, and wherein said delay tank has a top and a bottom and includes wall means which are joined at the bottom and which converge toward each other at the top.

6. The apparatus of claim 1 including means for rinsing the material as it is conveyed out of said container.

7. The apparatus of claim 1, wherein said first chamber is substantially V-shaped.

8. The apparatus of claim 1 including means for increasing the velocity of the solution as it is being drawn toward the second chamber.

9. An apparatus for treating material comprising:

(a) a solution container having a first and a second chamber, (b) means for supplying fluid to said first chamber, (c) means for conveying material into said first chamber in a substantially vertical direction, (d) means for conveying material out of said container through said second chamber, (e) means for drawing solution from said first chamber into said second chamber and substantially preventing the solution from returning from said second chamber directly back into said first chamber, (f) said container being enclosed, and means for sealing said container relative to the atmosphere being provided adjacent said means for conveying material into and out of the container and means for exhausting vapor from said container, (g) a delay tank positioned between said chambers, said delay tank having a top and a bottom and including wall means which are joined at the bottom and which converge toward each other at the top, and (h) said fluid supply means being adjacent the bottom of said delay tank, and means for conveying the fluid into said first chamber being located adjacent the top of said delay tank.

* * * * *